United States Patent [19]

Tao

[11] 4,392,940

[45] Jul. 12, 1983

[54] COAL-OIL SLURRY PREPARATION

[75] Inventor: John C. Tao, Perkiomenville, Pa.

[73] Assignee: International Coal Refining Company, Allentown, Pa.

[21] Appl. No.: 252,690

[22] Filed: Apr. 9, 1981

[51] Int. Cl.[3] ..... C10G 1/00; C10L 1/32

[52] U.S. Cl. ..... 208/8 LE; 44/51

[58] Field of Search ..... 208/8 LE; 44/51

[56] References Cited

U.S. PATENT DOCUMENTS

| | | | |
|---|---|---|---|
| 3,341,447 | 9/1967 | Bull et al. | 208/14 X |
| 3,583,900 | 6/1971 | Gatsis | 208/8 LE |
| 3,663,420 | 5/1972 | Jacobs et al. | 208/8 LE |
| 3,884,796 | 5/1975 | Hinderliter | 208/10 X |
| 4,039,425 | 8/1977 | Neavel | 48/201 X |
| 4,111,786 | 9/1978 | Sugimura et al. | 201/8 X |
| 4,159,897 | 7/1979 | Doehlert | 44/1 R X |
| 4,217,201 | 8/1980 | Chervenak | 208/8 R |
| 4,309,269 | 1/1982 | Denker et al. | 44/51 |
| 4,330,388 | 5/1982 | Anderson et al. | 208/8 LE |

FOREIGN PATENT DOCUMENTS

| | | | |
|---|---|---|---|
| 3600438 | 7/1976 | Fed. Rep. of Germany | 208/8 LE |

*Primary Examiner*—Delbert E. Gantz
*Assistant Examiner*—William G. Wright
*Attorney, Agent, or Firm*—Mark F. Wachter

[57] ABSTRACT

A pumpable slurry of pulverized coal in a coal-derived hydrocarbon oil carrier which slurry is useful as a low-ash, low-sulfur clean fuel, is produced from a high sulfur-containing coal. The initial pulverized coal is separated by gravity differentiation into (1) a high density refuse fraction containing the major portion of non-coal mineral products and sulfur, (2) a lowest density fraction of low sulfur content and (3) a middlings fraction of intermediate sulfur and ash content. The refuse fraction (1) is gasified by partial combustion producing a crude gas product from which a hydrogen stream is separated for use in hydrogenative liquefaction of the middlings fraction (3). The lowest density fraction (2) is mixed with the liquefied coal product to provide the desired fuel slurry. Preferably there is also separately recovered from the coal liquefaction LPG and pipeline gas.

12 Claims, 1 Drawing Figure

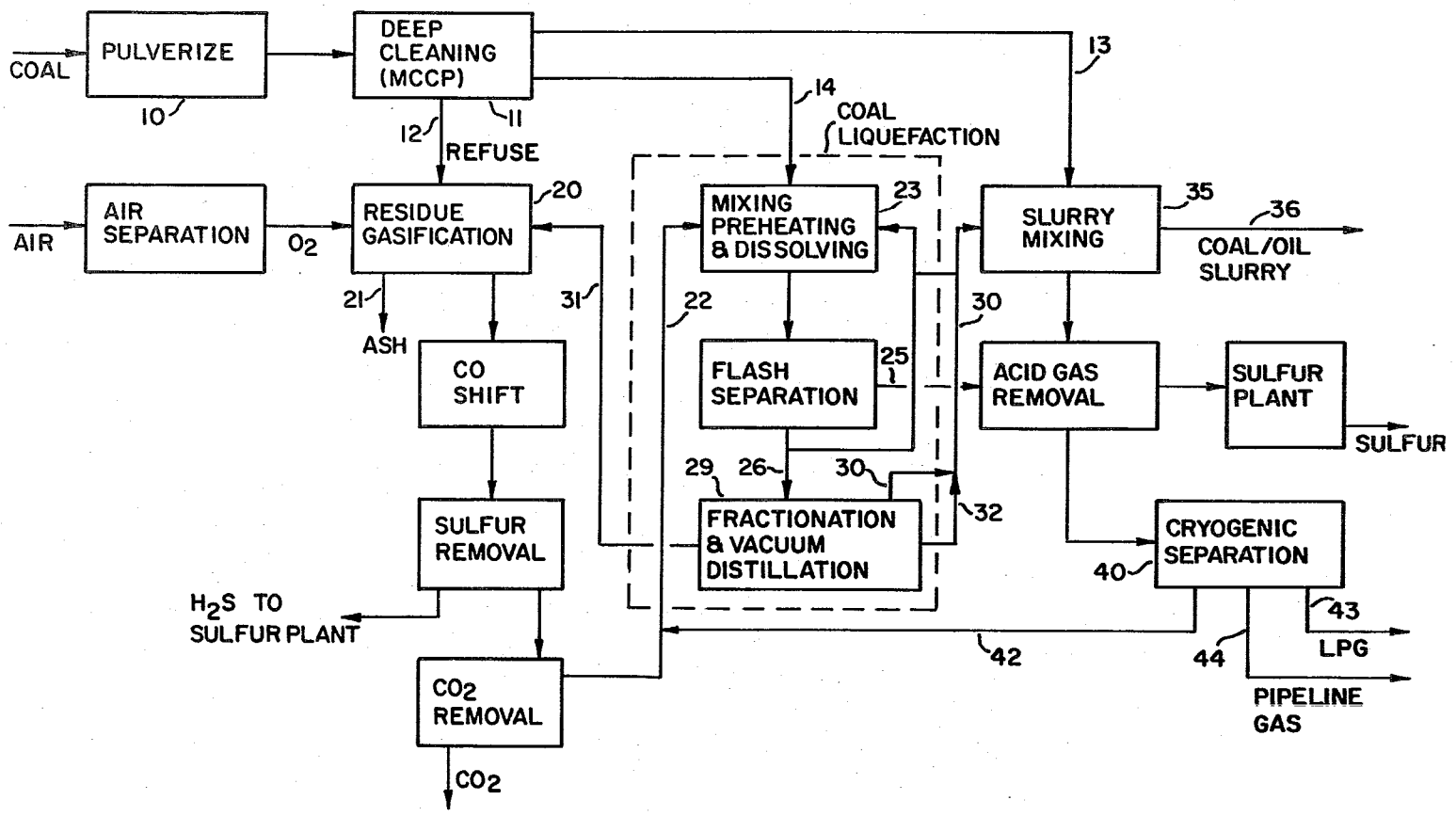
COAL
AIR
PULVERIZE
10
AIR SEPARATION
$O_2$
DEEP CLEANING (MCCP)
11
12
REFUSE
RESIDUE GASIFICATION
20
21
ASH
13
14
COAL LIQUEFACTION
MIXING PREHEATING & DISSOLVING
23
22
FLASH SEPARATION
25
26
FRACTIONATION & VACUUM DISTILLATION
29
30
31
32
SLURRY MIXING
35
36
COAL/OIL SLURRY
ACID GAS REMOVAL
SULFUR PLANT
SULFUR
CO SHIFT
SULFUR REMOVAL
$H_2S$ TO SULFUR PLANT
$CO_2$ REMOVAL
$CO_2$
CRYOGENIC SEPARATION
40
42
43
44
LPG
PIPELINE GAS

COAL-OIL SLURRY PREPARATION

The Government of the United States of America has rights in this Invention pursuant to Contract No. DE-AC05-780R03054 (as modified) awarded by the Department of Energy.

BACKGROUND OF THE INVENTION

The present invention relates to the preparation of slurries of solid coal particles in hydrocarbon liquid and is particularly concerned with the treatment of high sulfur coal to obtain a coal/oil slurry of acceptably low sulfur content wherein the hydrocarbon carrier liquid is a coal-derived oil.

The so-called "energy shortage" in recent years has given rise to extensive effort to find substitutes for previously utilized liquid and gaseous fuels derived from petroleum. Among the several avenues pursued is the utilization of abundantly available coal, either as a solid fuel or after its conversion to liquid and/or gaseous fuel products. A large part of the available coal is of undesirably high sulfur content (as much as up to about 3% or more sulfur by weight) giving rise to problems of environmental pollution, so that the relatively high costs of removal of sulfur from the raw coal, from the fluid fuels that can be derived from the coal or from the stack gases obtained in the combustion of the sulfur-containing solid or fluid fuels, is a major item in the cost of the obtained energy.

In modern coal treating plants the as mined coal (ROM) is crushed and separated into several size ranges for cleaning, comprising at least a coarse coal fraction, a fraction of intermediate size range and a fine coal fraction. Each fraction is separately cleaned in a manner deemed best for that fraction. In the typical cleaning operation a refuse fraction is removed from the remaining coal by gravity separation; employing such facilities as heavy media cyclones, fine coal jigs, Deister tables, or water-only hydroclones.

In some instances gravity separation may also be employed to further fractionate the good coal fraction, from which the refuse was removed, for recovery of a "deep-cleaned" float fraction of lowest sulfur and ash content.

Among the known methods proposed or used for initial treatment of crushed as mined coal is that generally designated "Multi-stream Coal Cleaning System" (MCCS) or 37 Multi-stream Coal Cleaning Process" (MCCP). The features of this system and process are described in Coal Age, January 1976 at pages 86 to 88, as presenting an advanced technology for removing sulfur from certain types of coal abundant in the eastern Appalachian coal fields.

By the use of a high density aqueous medium, such as a suspension of magnetite, the crushed coal is initially separated into (1) a refuse fraction which sinks in the medium, and which fraction contains a major part of the sulfur and minerals; and (2) a washed coal fraction of reduced sulfur and ash content. In a second step, conducted largely similarly to that of the first step, the already partly cleaned coal is further separated in a dense liquid medium at lower gravity into a sink fraction comprising coal of medium average sulfur content and a "deep-cleaned" low sulfur coal fraction (less than 1% by weight sulfur). Cyclones are employed in each of the gravity separation steps wherein the liquid medium is circulated at high velocity such that the lighter product rises to the top and is drained off, while the heavier fraction which sinks to the bottom, is there removed from the vessel. The aqueous medium is drained from the solid product and the magnetite is recycled into the cyclone.

A demonstration plant employing MCCP has been constructed and is in successful operation at the Homer City electric generating station in Indiana, Pa. The facility takes coal of about 2.6% sulfur and cleans it to obtain a middlings fraction containing about 2.2% total sulfur and a deep cleaned fraction containing less than 1% sulfur (about 0.8%).

While the conversion of coal into gas was an earlier established commercial technology in the United States to supply gas then needed for cooking and illumination, these gas plants were largely abandoned after World War II as pipeline transported natural gas came to be widely distributed. On the other hand, while conversion of coal to liquid fuel was in large scale operation in Germany, such process has not been employed on a commercial scale in the United States. In recent years, however, considerable research and development, funded by the U.S. government and by private industry, has gone into the development of scaled up technology for conversion of coal into oil and gas at prices competitive with the crude petroleum sources. Among the various methods proposed for liquefaction of coal, the better known are: carbonization, hydrocarbonization, direct hydrogenation, solvent extraction, the Fischer-Tropsch catalytic synthesis process, and the treatment of coal with oil to effect liquefaction.

The above processes are summarized and the literature articles describing the same in detail are identified in the introductory portion of U.S. Pat. No. 4,159,897. In addition to the citations in the aforesaid patent, among the more important systems proposed for conversion of coal to liquid fuels is that known as "SRC" (Sovlent Refined Coal) and a latter development of that process designated "Recycle SRC." These processes are described in a paper presented by Schmid, B. K. and Jackson, D. M. at the Fourth Annual International Conference on Coal Gasification, Liquefaction and Conversion to Electricity, University of Pittsburgh, August 2–4, 1977, under the title "Recycle SRC Processing for Liquid and Solid Fuels." Patents describing the SRC process or related similar processes, include: U.S. Pat. Nos. 3,341,447; 3,884,796; and 4,111,786.

In the original version of the SRC process (now generally known as SRC I) a distillate liquid is used for dissolving the coal, with subsequent recovery of the distillate for recycle as the solvent for the process. The primary product from this process is a low-ash, low-sulfur solid, designated "solvent refined coal." In the Recycle SRC process, a portion of the product slurry rather than a distillate liquid is employed as the solvent for the coal. A variation of the Recycle SRC process, now known as "SRC II," is discussed at length in a paper presented by Schmid, B. K. and Jackson, D. M. at the Third Annual International Conference on Coal Gasification and Liquefaction, University of Pittsburgh, August 3–5, 1976. In the SRC II process mode the dissolved coal is converted entirely to liquid fuel and by-product gases. By the several variations of the SRC process, one can produce distillate liquid, solid low-sulfur, low-ash coal, or combinations of these major products.

In all variations of the SRC processes the same general chemical reactions occur. These reactions include:

dissolution of the coal in the solvent, hydrogenation of the dissolved coal to remove sulfur, nitrogen and some oxygen, and hydrocracking of the dissolved coal to form liquid and gaseous products. The undissolved mineral residue and heavy bottoms remaining after separation of the obtained liquid products is gasified by reaction with steam and oxygen, the product gas being then subjected to shift conversion and purification, thereby providing hydrogen for use in the SRC process.

Coal was also used for many years as the raw material source for production of synthesis gas for the chemical and fertilizer industries. However, in the late 1940's and 1950's, such use of coal was displaced by the increasing availability of natural gas. Here again, because of the crisis in the oil industry, wide spread activity was initiated for the development of coal gasification technologies, to provide desired gas products useful as clean fuel as well as for chemical feedstock. These developing new technologies were aimed at designing processes superior to those earlier employed. Among the better known of these later developed processes is that known as "Koppers-Totzek" Coal Gasification process (KT gasification). Another current coal gasification process is that called the Texaco coal gasification process (TCGP) and the closely related Texaco synthesis gas generation process (TSGGP). These processes are described in T.V.A. Symposium on Ammonia from Coal, May 8–10, 1979, at pages 72 to 85. The Winkler coal gasification process is described at pages 51–62 and 86–96 of the cited Symposium papers.

In the KT coal gasification process coal feedstocks of high ash and/or sulfur content can be utilized, contrary to the earlier solid-moving bed and fluidized bed processes. The finely dispersed coal is mixed homogenously with oxygen and optionally also with steam and fed to the KT gasifier through burners, wherein the coal particles are completely gasified. Part of the ash formed in combustion is discharged from the bottom of the gasifier as liquid slag. The remainder of the ash leaves the top of the gasifier as a fine dust, which together with small amounts of unconverted carbon is dispersed in the crude gas. After giving up heat to a waste heat boiler through which it is passed, the crude gas is cooled and most of the solid particles washed therefrom by a water spray. The further processing of the crude gas depends upon the ultimate intended use. In any event, sulfur removal is usually practiced, using any of the methods known in the art for treatment of acid gas. Carbon dioxide removal is common practice, generally with previously subjecting the gas to a CO shift reaction, particularly if increased hydrogen production is desired.

Except for particulars of operation, the general sequence in the other cited processes is largely similar to the previously described KT gasification. According to the above cited Symposium articles the gasification process can be employed in conjunction with a coal liquefaction operation, wherein the required hydrogen for liquefaction is produced from by-product residues. The composition of the gas obtained from the gasification of vacuum tower bottoms of SRC II operation, is given in Table 2 at page 84 of the Symposium paper.

Encouraging results have been reported in the partial substitution of coal for oil in boilers, wherein the coal in finely divided condition is suspended in the liquid fuel fed to a conventional oil-fired industrial burner. The initial coal-in-oil tests added pulverized coal to petroleum derived fuel oil. Later developments proposed as the liquid suspending agent for the pulverized coal, the liquid product obtained by liquefaction of part of the coal. Such operation is described, for example in U.S. Pat. Nos. 4,039,425 and 4,159,897.

SUMMARY OF THE INVENTION

The present invention is aimed at providing an improved and economically attractive process for production of coal/oil slurries useful as low-sulfur, low-ash clean fuel. In accordance with the invention coal, which may have a high sulfur content, is initially subjected in pulverized form to a cleaning operation wherein it is separated by gravity differentiation into (1) a fraction of highest density containing the major portion of non-coal mineral products and sulfur containing products, (2) a clean coal fraction of lowest density having a sulfur content of less than about 1% by weight, and (3) a middlings fraction of lower sulfur and ash content than said high density fraction. The highest density fraction is gasified by partial combustion, producing a crude gas product comprising oxides of carbon, hydrogen and hydrogen sulfide, from which the hydrogen is separated for use in coal liquefaction. The middlings fraction is subjected to liquefaction in the presence of hydrogen produced in the gasification of the highest density fraction. The lowest density fraction, optionally after pulverization to finer particle size range, is mixed with the liquefied coal product obtained from the middlings fraction to obtain a coal/oil slurry product useful as a pumpable fuel. In the preferred embodiment of the invention there are also recovered from the coal liquefaction step a liquid petroleum gas (LPG) comprising essentially $C_3+$ hydrocarbons and a fuel gas or so called "pipeline gas" comprising chiefly methane and minor quantities of $C_2$ hydrocarbons.

BRIEF DESCRIPTION OF THE DRAWING

The single FIGURE of the accompanying drawing is a schematic flow diagram of the process in accordance with the preferred form of the invention.

DETAILED DESCRIPTION

Referring to the drawing, the raw coal is crushed and size graded, and the size consist to be subjected to the subsequent cleaning operation is pulverized at 10 to desired size range, as say from about 100 mesh (Tyler standard screen) up to about 2 mm size. The pulverized coal from 10 is subjected to gravity separation at 11 to provide three fractions: a highest density fraction 12, a deep-cleaned fraction of lowest density 13 and a middlings fraction of intermediate density 14. Such separation into the three fractions of different density may be accomplished by methods generally known to the art for minerals and coal separation by sink-float techniques in liquid media, such as by jigging, Deister tables, water only hydroclones or heavy media cyclones. Preferably one may employ a process such as that above described as MCCP, wherein the separation is accomplished in a high density aqueous medium, such as a suspension of magnetite having the required concentration to obtain the selected partition.

By way of example, employing a typical coal cleaning plant operating in the MCCP mode, a bituminous coal feed having a selected particle size range, and containing about 2.5 to 3.0% sulfur and 11 to 12% ash is subjected to gravity separation in a cyclone containing an aqueous suspension of mangnetite having a specific gravity of about 1.8. The high density sink fraction 12 will comprise about 10–12% of the feed, and will contain the major part of the ash and sulfur components of the original feed. The remaining float fraction will comprise coal of lower sulfur and ash content than that of the original feed.

The obtained float fraction is next subjected to a second stage gravity separation in an aqueous suspension of magnetite at a selected specific gravity lower than that of the first gravity separation step, say at a sepcific gravity of about 1.3 to 1.4. There is obtained a sink fraction 14 containing most of the remaining sulfur and ash components and a float fraction 13 of deep-cleaned coal, which float fraction comprises about 50% of the original coal feed to the MCCP plant and will contain less than 1% total sulfur components and less than 15% of the ash contained in the original coal feed.

The specific gravity levels at which the highest density refuse fraction 12 is separated out and the remaining coal fraction further separated into the deep cleaned portion 13 and middlings portion 14, respectively, are determined by the characteristics of the particular coal feed with respect to ash and sulfur content. By preliminary analyses of the various cuts at successive gravity levels the optimum partition levels can be selected.

The highest density refuse fraction 12 is subjected to gasification, as indicated at 20 in the drawing. Any of the known coal gasification processes may be here employed, such as the KT process, the Texaco coal gasification process or the Winkler process, among others. Employing the KT gasification system, by way of example, the refuse fraction 12 is contacted in the gasifier with oxygen in the presence of steam, wherein ignition takes place, forming an ash withdrawn as liquid slag from the bottom of the gasifier via line 21. The remaining ash in the form of fine grained dust and unconverted carbon is withdrawn with the crude gas and the mixture cooled in a waste heat boiler. Most of the dust is subsequently removed from the cooled gas by water washing. The crude gas mixture will contain oxides of carbon, $H_2S$ and other sulfur gases, and hydrogen. The entire gas mixture is subjected to a water gas shift reaction over cobalt-molybdenum or other sulfur-resistant catalyst to convert the carbon monoxide (which constitutes 50 or more mole percent of the gas mixture) to $CO_2$ and hydrogen. Removal of $H_2S$ and $CO_2$ from product gas of the shift reaction may be accomplished by any of the available commerical systems for acid gas removal. Whatever system is selected for such purification there is obtained from the refuse gasification at 20, a hydrogen stream 22 of desired purity that is employed in the operation in accordance with the invention.

Commercially available processes for the purification of sulfur-containing gas streams and recovery of hydrogen-rich gas include: Rectisol (U.S. Pat. No. 2,863,527), Purisol (U.S. Pat. No. 3,505,784), Selexol (U.S. Pat. Nos. 2,649,166 and 3,362,133), among others. These processes employ various physical absorbents for the acid gas, such as methanol, N-methyl pyrrolidone, glycol ethers, dimethyl formamide, dimethyl sulfoxide, alkyol amines, among many other solvents proposed in the art.

The purified hydrogen stream 22 is employed to supply the hydrogen needed for the coal liquefaction step at 23. The middlings coal fraction 14 is subjected to liquefaction, by any of the known coal liquefaction processes employing hydrogenation, such as direct hydrogenation (e.g. by the H-Coal Process), solvent extraction techniques (e.g. Exxon Donor Solvent process), or SRC-I plus 2nd stage hydrocracking, or in the preferred embodiment, by use of the SRC II process or known similar operations. In the liquefaction of the middlings coal fraction the coal product from line 14 is dissolved in hot recycle slurry from the liquefaction step and hydrogenated by reaction with the hydrogen including that from lines 22 and 42, effecting thereby hydrocracking of the dissolved coal to liquid and gaseous products. The liquefaction of the coal is carried out at elevated temperature and pressure and optionally in the presence of a hydrogenation catalyst.

Following liquefaction at 23 the obtained reaction mixture is flashed to separate out a gaseous product 25 leaving a liquid slurry 26. The liquid slurry is subjected to fractionation and vacuum distillation as indicated at 29, obtaining as distillate a benzene soluble hydrocarbon oil withdrawn via line 30 and a bottoms product residue composed of a slurry of higher boiling hydrocarbons and unconvented solid coal particles. A major portion of the obtained bottoms slurry is recycled via line 31 to the residue gasification step at 20. A minor portion of the bottoms slurry from 29 is added to the lighter oil in line 30 via line 32.

The deep-cleaned coal fraction of lightest density in line 13, preferably after being subjected to further pulverization, desirably to about through 200 mesh size, is admixed with liquid hydrocarbon product obtained from the coal liquefaction at 23. As shown by the flow diagram, the mixture in line 30, comprising the light oil distillate and the portion of heavy hydrocarbons plus unconvented coal slurry added thereto is admixed at 35 with the finely divided clean coal from line 13, forming the desired coal/oil slurry discharged in line 36 and recovered. Such coal/oil slurry containing as much as 50% or more by weight of solid coal particles will be acceptably low in sulfur and suitable for use as a boiler fuel.

The gaseous products formed in the coal liquefaction step, withdrawn via line 25, are separated from the liquid oil by conventional vapor/liquid separation and may be further fractionated by conventional means. For example, after removing sulfur and other acid gas, the $C_4$ and lighter fraction may be subjected to cryogenic separation, as indicated at 40, for separate recovery of an LPG fraction and a pipeline gas fraction as indicated by lines 43 and 44. Hydrogen may be recovered from the lighter gas fraction in conventional manner including CO shift reaction and recycled via line 42 for use in liquefaction at 23, supplementing that obtained from residue gasification at 20.

In a typical operation a bituminous coal containing 3% sulfur by weight, subjected to cleaning and gravity separation by the MCCP process at 11 will provide a dense residue fraction 12 comprising about 14 to 15% of the coal feed charged, having a sulfur content of about 9.5%+. The obtained middlings fraction 14 will comprise about 55 to 60% of the original coal charge and will contain about 2.5% sulfur. The deep-cleaned coal fraction 13 will comprise about 25 to 30% of the initial coal feed and will contain less than 1% sulfur (about 0.8–0.9%).

The gasification of the residue fraction 12 will obtain about 360 pounds of hydrogen for each ton of the material subjected to gasification. In the distillation of the liquefied middlings coal fraction 14, there is obtained a liquid oil product constituting about 45 to 50% by weight of the coal fraction subjected to liquefaction. The residue slurry obtained as bottoms in vacuum distillation of the liquefied coal product, is split so that the major portion 31 (about 65–70%) is returned to the gasification operation at 20 and the remaining minor portion (35–30%) is admixed in the deep-cleaned coal slurry formed at 35.

The following example illustrates a complete operation in accordance with preferred embodiments of the invention. It will be understood, however, that any of the individual operations respectively for (a) initial gravity fractionation and cleaning of the coal to be processed, (b) processing the several fractions respectively by gasification, liquefaction etc., (c) separation of products and (d) purification of the obtained gas product streams, may be substituted by other such processing operations known in the art.

EXAMPLE

In a MCCP plant designed to treat (dry basis) 25,300 tons per day (T/D) of coal, the material charged is a screened bituminous coal fraction in the approximate size range of 9×100 mesh (Tyler) and having an elemental analysis as set out in Table 1, below:

TABLE 1

| ELEMENTAL ANALYSIS | |
|---|---|
| | wt. % |
| C | 69.9 |
| H | 4.8 |
| S | 3.0 |
| O | 7.5 |
| N | 1.3 |
| ASH | 13.5 |

The charged coal is cleaned and fractionated in an aqueous high density liquid suspension of magnetite having a specific gravity of 1.8, whereby there is obtained a sink fraction of "refuse" (12) constituting about 3,500 T/D. The float fraction is subjected to further gravity separation in an aqueous magnetite suspension at a specific gravity of 1.3, thereby obtaining a sink fraction (14) constituting about 14,600 T/D and a float fraction (13) of lowest density deep-cleaned coal constituting about 6,800 T/D.

The highest density refuse or residue fraction (12) is subjected to gasification employing a KT gasifier. The residue fraction is contacted at 1500°–1600° C. with oxygen (99% purity) at a dosage of 4,460 T/D of oxygen in the presence of added steam. The reaction product leaving the gasifier includes a substantially carbon-free molten slag, ash dust containing small amounts of ungasified carbon and a raw gas mixture comprising elementary nitrogen, hydrogen, steam, oxides of carbon, hydrogen sulfide and other sulfur bearing species.

The gaseous products separated from the slag but including the dust is subjected to a water gas shift reaction over sulfur resistant shift catalyst. Addition of steam may not be necessary depending upon the steam content of the gas mixture. The shift reaction product is treated to remove acid gas, including $H_2S$ and $CO_2$ by the Selexol process. Thus, the gas is contacted with Selexol solvent effecting removal of $CO_2$, COS, and $H_2S$. The nitrogen is not removed. The resulting hydrogen-rich gas product is of 98.5 purity. There is thus obtained 630 T/D of hydrogen gas product.

The middlings coal fraction (14) is subjected to liquefaction by the SRC II (liquid) recycle process. This fraction is slurried with 1.6 parts of 450°–850° F. product oil per part of coal and consumes 4.8% of hydrogen (including recovered recycle hydrogen and the hydrogen stream (22) derived from the refuse gasification). The liquefaction is carried out at 850° F. and at a pressure of 2,000 psia. The $C_4$ and lighter gas is separated and the liquid subjected to vacuum distillation obtaining a distillate in the atmospheric boiling range of up to about 850° F. and a bottoms residue slurry. The resulting distillate, comprises about 900–950 pounds per ton of coal charged to liquefaction. Recycle solvent is at steady state. The rest of the distillate is mixed with the deep-cleaned coal fraction (13). Of the vacuum bottoms slurry 68% is recycled to the residue gasification step (20) and the rest also admixed with the coal/oil slurry recovered as product (36).

The gaseous $C_4$ and lighter gas fraction recovered from the coal liquefaction operation is treated to remove any remaining sulfur and the thus purified gas subjected to cryogenic separation. The purified hydrogen thus obtained is recycled to coal liquefaction operation and the remainder of the gas recovered as LPG and pipeline gas fractions. The ultimate products recovered per ton of coal initially charged to the MCCP plant are set out in Table 2 (rounded figures).

TABLE 2

| | amt. product per ton of raw coal (10) |
|---|---|
| Coal/oil slurry (36) | 1195 pounds |
| Sulfur from sulfur plant | 23 pounds |
| Pipeline gas ($C_1 + C_2$) | 710 SCF |
| LPG | 0.15 Barrel |

The process of the invention is applicable to coal of any grade or quality but is particularly beneficial in the treatment of high sulfur bituminous and sub-bituminous coal fractions.

What is claimed:

1. A process for producing a pumpable coal/oil slurry product, useful as a liquid fuel, from pulverized sulfur-containing coal which comprises the steps of:

(1) subjecting said pulverized coal to gravity separation to provide
  (a) a highest density refuse portion comprising the major portion of the ash and sulfur content of the coal feed,
  (b) a middlings coal portion of lower ash and sulfur content than said high density portion, and
  (c) a deep-cleaned lowest density coal portion having a sulfur content of less than about 1%;

(2) subjecting said highest density refuse portion to gasification by partial combustion in oxygen
  (a) thereby obtaining a crude gas product comprising hydrogen, oxides of carban, hydrogen sulfide and steam, thereafter
  (b) subjecting said crude gas product to a water gas shift reaction in the presence of steam and over sulfur-resistant catalyst, to convert contained carbon monoxide to carbon dioxide with accompanying further production of hydrogen, and
  (c) removing said carbon dioxide and hydrogen sulfide from the products of said shift reaction to recover a purified hydrogen-rich gas;

(3) introducing said middlings coal portion into a liquefaction zone and treating the same with a coal derived solvent and with said purified hydrogen-rich gas under conditions of elevated temperature and pressure, thereby effecting liquefaction of said middlings coal portion to produce a coal derived, benzene soluble hydrocarbon oil distillate;

(4) slurrying said deep-cleaned coal portion of lowest density from step (1) with said coal derived hydrocarbon oil of step (3) to provide said coal/oil slurry product.

2. The process as defined in claim 1 wherein said pulverized coal subjected to gravity separation in step (1) has a particle size of up to about 2 millimeters.

3. The process as defined in claim 1 wherein said pulverized coal subjected to gravity separation in step (1) has a sulfur content in excess of 2.5% by weight.

4. The process as defined in claim 1 wherein said gravity separation is effected in an aqueous medium comprising a suspension of magnetite.

5. The process as defined in claim 4 wherein said highest density portion has an ash content in excess of 60% by weight and a sulfur content in excess of 6% by weight.

6. The process as defined in claim 1 wherein said lowest density coal portion is further pulverized to a size range to pass through a 200 mesh screen, prior to admixture with said coal derived hydrocarbon oil.

7. The process as defined in claim 1 wherein said coal/oil slurry product formed in step (4) further contains unconverted solid coal recovered as residual bottoms in said liquefaction of step (3).

8. The process as defined in claim 1 wherein solvent containing unliquefied coal is separated from said liquefaction in step (3) and at least a portion thereof is subjected to said gasification reaction carried out in step (2).

9. The process as defined in claim 1 wherein solvent containing unliquefied coal is separated from said liquefaction in step (3) and at least a portion thereof is admixed in said coal/oil slurry product.

10. The process as defined in claim 1 wherein the liquefaction product obtained in said liquefaction of step (3) also includes a gas mixture which is separated from said coal derived hydrocarbon oil.

11. The process as defined in claim 10 wherein said gas mixture is separated to provide a liquefied petroleum gas fraction and a pipeline gas fraction.

12. The process as defined in claim 10 wherein hydrogen-rich gas is separated from said gas mixture and recycled to said coal liquefaction step (3).

* * * * *

UNITED STATES PATENT AND TRADEMARK OFFICE

CERTIFICATE OF CORRECTION

PATENT NO. : 4,392,940

DATED : July 12, 1983

INVENTOR(S) : John C. Tao

It is certified that error appears in the above–identified patent and that said Letters Patent are hereby corrected as shown below:

Col. 1, line 49 - Delete "37" and insert in its place quotation marks, so that line 49 will read as follows:
(MCCS) or "Multi-stream Coal Cleaning Process"

Col. 2, line 38 - Delete the word "Sovlent" and insert in its place --Solvent--.

Col. 2, line 38 - Delete the word "latter" and insert in its place --later--.

Col. 8, line 52 - Delete the word "carban" and insert in its place --carbon--.

Signed and Sealed this

*Fourth* Day of *October 1983*

[SEAL]

*Attest:*

GERALD J. MOSSINGHOFF

*Attesting Officer*

*Commissioner of Patents and Trademarks*